US011043153B2

(12) United States Patent
Dai et al.

(10) Patent No.: US 11,043,153 B2
(45) Date of Patent: Jun. 22, 2021

(54) CONTROL CIRCUIT BOARD, ADDITIONAL CIRCUIT BOARD AND DISPLAY DEVICE

(71) Applicants: HEFEI BOE DISPLAY TECHNOLOGY CO., LTD., Anhui (CN); BOE TECHNOLOGY GROUP CO., LTD., Beijing (CN)

(72) Inventors: Ke Dai, Beijing (CN); Tao Li, Beijing (CN); Liugang Zhou, Beijing (CN)

(73) Assignees: HEFEI BOE DISPLAY TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/527,560

(22) Filed: Jul. 31, 2019

(65) Prior Publication Data

US 2020/0273390 A1 Aug. 27, 2020

(30) Foreign Application Priority Data

Feb. 25, 2019 (CN) ..... 201910138431.7

(51) Int. Cl.
*G09G 5/00* (2006.01)
*G09G 3/20* (2006.01)

(52) U.S. Cl.
CPC ..... *G09G 3/20* (2013.01); *G09G 2310/027* (2013.01); *G09G 2310/0297* (2013.01); *G09G 2320/0276* (2013.01); *G09G 2320/0673* (2013.01)

(58) Field of Classification Search
CPC .. G09G 3/20; G09G 3/2088; G09G 2310/027; G09G 2320/0673; G09G 2320/0276; G09G 2320/08; G09G 2310/0297
See application file for complete search history.

(56) References Cited

U.S. PATENT DOCUMENTS

2015/0348476 A1* 12/2015 Yeo ..... G09G 3/006 345/690

* cited by examiner

*Primary Examiner* — Adam R. Giesy

(57) ABSTRACT

A control circuit board, an additional circuit board and a display device. The control circuit board includes a timing control circuit, the timing control circuit is configured to read a configuration code from a storage circuit on an additional circuit board outside the control circuit board, the configuration code includes a first code for configuring the timing control circuit, and the timing control circuit is further configured to generate, based on the first code, a control signal for controlling the display panel.

17 Claims, 5 Drawing Sheets

CONTROL CIRCUIT BOARD, ADDITIONAL CIRCUIT BOARD AND DISPLAY DEVICE

CROSS-REFERENCE TO RELATED APPLICATION

The present application claims priority to Chinese Patent Application No. 201910138431.7, filed on Feb. 25, 2019, the disclosure of which is incorporated herein by reference in its entirety as part of the present application.

TECHNICAL FIELD

The embodiments of the present disclosure relate to a control circuit board, an additional circuit board and a display device.

BACKGROUND

Currently, more and more manufacturers are promoting the platform-based design of display products. The platform-based design may improve the production efficiency, reduce the production costs, and improve the versatility of the products. For example, the platform-based design may promote the serializing of the display products, and some components may be shared between the display products of a same series.

SUMMARY

At least one embodiment of the present disclosure provides a control circuit board, comprising a timing control circuit, the timing control circuit is configured to read a configuration code from a storage circuit on an additional circuit board outside the control circuit board, the configuration code comprises a first code for configuring the timing control circuit, and the timing control circuit is further configured to generate, based on the first code, a control signal for controlling a display panel.

For example, in the control circuit board provided by an embodiment of the present disclosure, the timing control circuit is further configured to distribute a remaining configuration code other than the first code in the configuration code to an outside of the timing control circuit.

For example, the control circuit board provided by an embodiment of the present disclosure further comprises a power management circuit, the configuration code further comprises a second code for configuring the power management circuit, and the power management circuit is configured to obtain the second code from the timing control circuit and generate, based on the second code, a voltage signal for driving the display panel.

For example, in the control circuit board provided by an embodiment of the present disclosure, the timing control circuit is further configured to provide a data signal to a data driving circuit on the additional circuit board.

For example, the control circuit board provided by an embodiment of the present disclosure further comprises a data signal adjusting circuit, the configuration code further comprises a third code for configuring the data signal adjusting circuit, the data signal adjusting circuit is configured to obtain the third code from the timing control circuit and generate, based on the third code, a gamma reference voltage configured to be applied to the data driving circuit on the additional circuit board.

For example, in the control circuit board provided by an embodiment of the present disclosure, the timing control circuit comprises a timing controller.

For example, in the control circuit board provided by an embodiment of the present disclosure, the power management circuit comprises a power management integrated circuit.

For example, in the control circuit board provided by an embodiment of the present disclosure, the data signal adjusting circuit comprises a gamma buffer.

For example, in the control circuit board provided by an embodiment of the present disclosure, the timing control circuit comprises a binary synchronization serial bus interface, and the timing control circuit distributes a remaining configuration code other than the first code in the configuration code to the outside of the timing control circuit through the binary synchronization serial bus interface.

At least one embodiment of the present disclosure further provides an additional circuit board, which is configured to be bonded to a display panel and comprises a data driving circuit and a storage circuit, the storage circuit is configured to store a configuration code, and the configuration code is capable of being read by a control circuit board to configure the control circuit board, and the data driving circuit is configured to provide a grayscale voltage signal to the display panel.

For example, in the additional circuit board provided by an embodiment of the present disclosure, the configuration code comprises a first code for configuring the timing control circuit, and the timing control circuit is configured to generate, based on the first code, a control signal for controlling the display panel.

For example, in the additional circuit board provided by an embodiment of the present disclosure, the configuration code comprises a second code for configuring a power management circuit, and the power management circuit is configured to generate, based on the second code, a voltage signal for driving the display panel.

For example, in the additional circuit board provided by an embodiment of the present disclosure, the configuration code comprises a third code for configuring a data signal adjusting circuit, and the data signal adjusting circuit is configured to generate, based on the third code, a gamma reference voltage configured to be applied to the data driving circuit.

For example, the additional circuit board provided by an embodiment of the present disclosure further comprises a serial peripheral interface, and the configuration code stored in the storage circuit is read through the serial peripheral interface.

At least one embodiment of the present disclosure further provides a display device, which comprises an control circuit board provided by any embodiment of the present disclosure, an additional circuit board provided by any embodiment of the present disclosure and a display panel, the additional circuit board is bonded to the display panel, and the additional circuit board is in signal connection with the control circuit board.

For example, the display device provided by an embodiment of the present disclosure further comprise a flexible circuit board, and the control circuit board is in signal connection with the additional circuit board through the flexible circuit board.

At least one embodiment of the present disclosure further provides a display device, which comprises an additional circuit board provided by any embodiment of the present disclosure and a display panel, and the additional circuit board is bonded to the display panel.

At least one embodiment of the present disclosure further provides a display device, comprising a control circuit board, an additional circuit board and a display panel, the additional circuit board is configured to be bonded to the display panel and comprises a data driving circuit and a storage circuit, the storage circuit is configured to store a configuration code, the configuration code is capable of being read by the control circuit board to configure the control circuit board, and the data driving circuit is configured to provide a grayscale voltage signal to the display panel, the control circuit board comprises a timing control circuit, a power management circuit and a data signal adjusting circuit, the timing control circuit is configured to read the configuration code from the storage circuit on the additional circuit board, the configuration code comprises a first code for configuring the timing control circuit, a second code for configuring the power management circuit, and a third code for configuring the data signal adjusting circuit, the timing control circuit is further configured to generate, based on the first code, a control signal for controlling the display panel and distribute a remaining configuration code other than the first code in the configuration code to an outside of the timing control circuit, the power management circuit is configured to obtain the second code from the timing control circuit and generate, based on the second code, a voltage signal for driving the display panel, and the data signal adjusting circuit is configured to obtain the third code from the timing control circuit and generate, based on the third code, a gamma reference voltage configured to be applied to the data driving circuit on the additional circuit board.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

In order to make the objectives, technical solutions and advantages of the embodiments of the present disclosure more clear, the technical solutions of the embodiments of the present disclosure will be clearly and completely described below with reference to the accompanying drawings of the embodiments of the present disclosure. Apparently, the described embodiments are only part of the embodiments of the present disclosure, but not all the embodiments. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
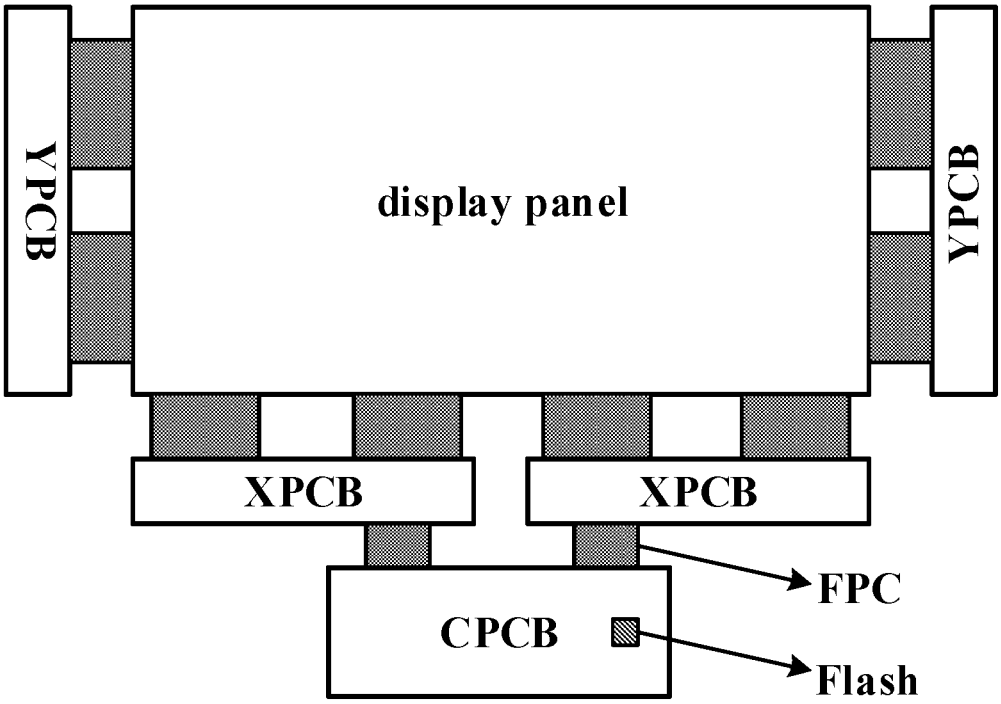
FIG. 1 is a schematic diagram of a display device.
Figure 2:
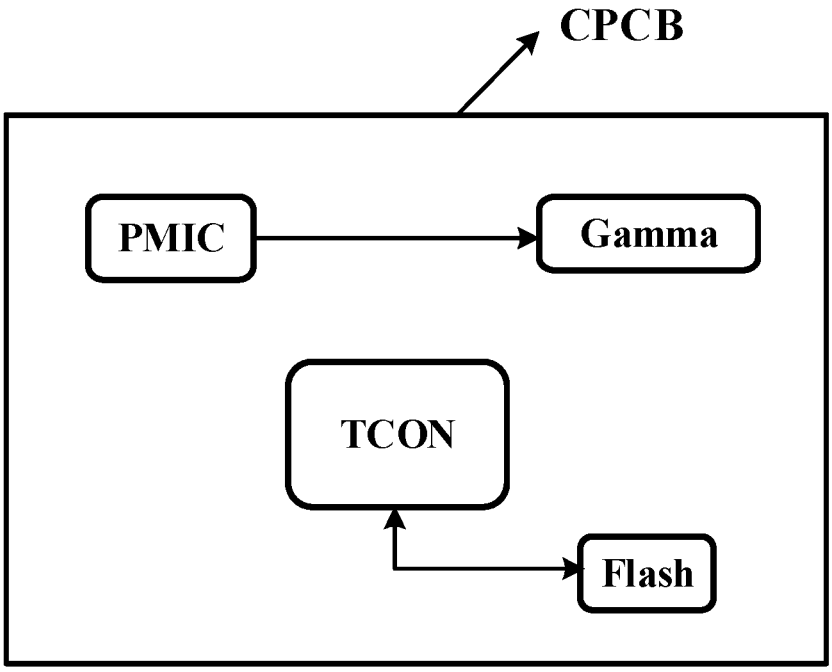
FIG. 2 is a schematic diagram of an example of a control circuit board in the display device of FIG. 1.

FIG. 1 is a schematic diagram of a display device, and the display device includes a display panel and a drive circuit system thereof. As shown in FIG. 1, the drive circuit system for the display panel includes a control circuit board (CPCB), an X-direction circuit board (XPCB) and a Y-direction circuit board (YPCB). FIG. 2 is a schematic diagram of an example of the control circuit board CPCB of FIG. 1. For example, as shown in FIG. 2, the control circuit board CPCB includes a timing controller TCON, a storage chip Flash, a power management chip PMIC and a gamma buffer Gamma. It should be noted that, in the embodiments of the present disclosure, in order to distinguish the X-direction circuit board (XPCB) from the Y-direction circuit board (YPCB), the X-direction circuit board is referred to as the first circuit board, and the Y-direction circuit board is referred to as the second circuit board, and this is the same for the following embodiments, which will not be repeated hereinafter.

For example, the timing controller TCON of the control circuit board CPCB is configured to generate various control signals for controlling the display panel. The power management chip PMIC is configured to generate various working voltages required by the display panel; and the gamma buffer Gamma is configured to generate a gamma reference voltage. For example, the storage chip Flash stores a configuration code for configuring the timing controller TCON. For example, when the display device is energized, the timing controller TCON can read the configuration code from the storage chip Flash to complete a configuration operation. For example, the power management chip PMIC and the gamma buffer Gamma can respectively store corresponding configuration codes, and when the display device is energized, the power management chip PMIC and the gamma buffer Gamma can respectively read corresponding configuration codes to complete their own configuration operations.

For example, the first circuit board XPCB is in signal connection with the control circuit board CPCB through a flexible circuit board FPC, and the first circuit board XPCB is configured to transmit a control signal generated by the control circuit board CPCB to the display panel. For example, the first circuit board XPCB may include a data driving circuit, and the data driving circuit can receive the gamma reference voltage and a data signal, and generate, based on the gamma reference voltage and the data signal, a grayscale voltage signal for driving the display panel to display images.

For example, the second circuit board YPCB may include a gate driving circuit, and the gate driving circuit is configured to generate a scan drive signal for driving the display panel to display images. For example, the scan drive signal can drive the display panel to display images in a progressive scanning manner.

It should be noted that the amounts of the first circuit board XPCB and the second circuit board YPCB in FIG. 1 are merely illustrative, and the embodiments of the present disclosure include, but are not limited to, the shown case. For example, four first circuit boards XPCB and the like may be arranged. In addition, if a Gate on Array (GOA) is adopted instead of the gate driving circuit, the second circuit board YPCB may not be arranged.

Currently, in the production of the display products, various manufacturers are actively promoting the platform-based design. For example, 32-inch products and smaller products may adopt an "X+C" scheme, that is, the control circuit board CPCB and the first circuit board XPCB may be sold together with the display panel, and related configuration parameters of the control circuit board CPCB may be separately set based on practical situations of various production sites, thereby realizing the platform-based design.

For example, in the production of 43-inch products and larger products, because the control circuit board CPCB and the first circuit board XPCB are separately designed, the control circuit board CPCB and the first circuit board XPCB are sold separately, for example, at the customer side, the control circuit board CPCB and the first circuit board XPCB are connected through a flexible circuit board. Due to the differences in the process, assembling and the like of production equipment at various production sites, display panels produced by different production equipment are different, and the configuration parameters required for the display panels produced by different production equipment are also different. Therefore, in this case, control circuit boards CPCB required by display panels which are produced by different production equipment are also different, the storage chip Flash in each of the control circuit boards CPCB stores the configuration code of the corresponding display panel, and a same control circuit board CPCB cannot be shared by different display panels, thereby hindering the realization of the platform-based design.

In addition, as shown FIG. 2, the configuration code used for the timing controller TCON is stored in the storage chip Flash, and the power management chip PMIC and the gamma buffer Gamma also include respective storage units for storing the corresponding configuration code. In this case, the control circuit board CPCB is required to store a lot of configuration codes, which is inconvenient for the management of the configuration codes and thus affects the production efficiency and also increases the production costs.

At least one embodiment of the present disclosure provides a control circuit board, which includes a timing control circuit. The timing control circuit is configured to read configuration codes from the storage circuit on the additional circuit board outside the control circuit board, the configuration code includes a first code used for configuring the timing control circuit, and the timing control circuit is also configured to generate, based on the first code, a control signal for controlling a display panel. At least one embodiment of the present disclosure also provides an additional circuit board and a display device corresponding to the above-mentioned control circuit board.

In the control circuit board, the additional circuit board and the display device provided by the embodiments of the present disclosure, by arranging the storage circuit in the additional circuit board, the configuration code stored in the storage circuit can be set based on the parameter of the display panel, so that the display panels having different characteristics can share a same control circuit board, thereby improving the production efficiency and reducing the production costs.

Hereinafter, the embodiments of the present disclosure will be described in detail in conjunction with the accompanying drawings.

Figure 3:
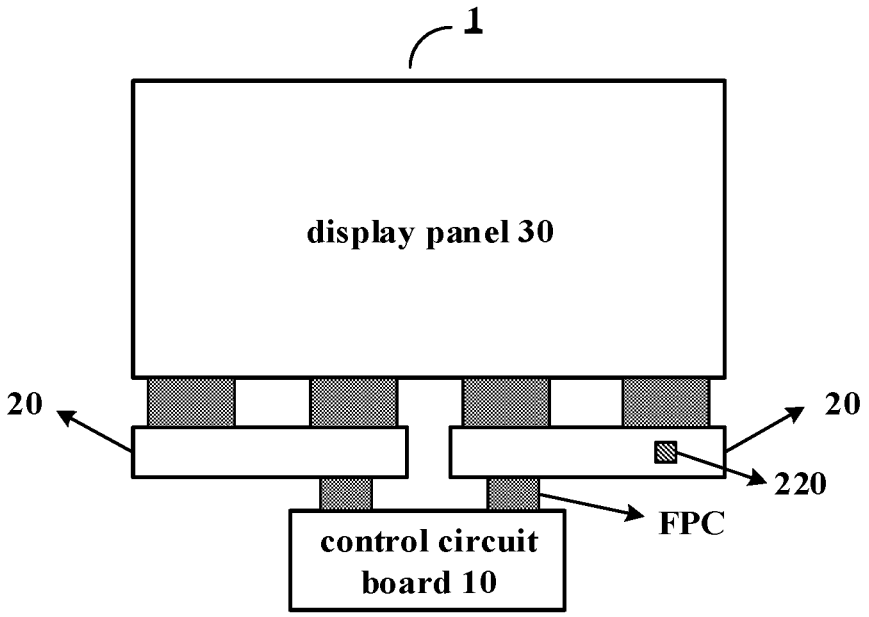
FIG. 3 is a schematic diagram of a display device provided by some embodiments of the present disclosure.

Some embodiments of the present disclosure provide a display device 1, as shown in FIG. 3, the display device 1 includes a control circuit board 10, a first circuit board 20 and a display panel 30. For example, the first circuit board 20 (an example of the additional circuit board of the embodiments of the present disclosure) can be in signal connection with the control circuit board 10 through a flexible circuit board FPC. It should be noted that only two first circuit boards 20 are shown in FIG. 3, however, the embodiments of the present disclosure do not limit the amount of the first circuit boards 20 included in the display device 1, and the amount of the first circuit boards 20 may be set based on the practical situation, for example, the display device 1 may also include four first circuits board 20.

For example, as shown in FIG. 3, the first circuit board 20 includes a storage circuit 220. For example, the storage circuit 220 is configured to store a configuration code, and the configuration code can be read by the control circuit board 10 to configure the control circuit board 10. For example, the configuration code may be set based on the corresponding display panel 30. For example, when the display device is energized, the control circuit board 10 can read the configuration code from the storage circuit 220 of the first circuit board 20, and then the control circuit board 10 can configure one or more circuits of the control circuit board 10 based on the configuration code.

It should be noted that as shown in FIG. 3, in a case where the display device 1 includes a plurality of first circuit boards 20, the storage circuit 220 may be arranged in at least one first circuit board 20, the embodiments of the present disclosure include, but are not limited to, this case. For example, the storage circuit 220 may also be arranged respectively in two first circuit boards 20.

In the display device 1 provided by the embodiments of the present disclosure, for example, the first circuit board 20 can be bonded to the display panel 30, so that the first circuit board 20 can be sold together with the display panel 30. For example, the first circuit board 20 can bonded with the display panel 30 through a flexible circuit board, an anisotropic conductive adhesive and so on. For example, in the display device 1 as shown in FIG. 3, two first circuit boards 20 are bonded to the display panel 30, so that the two first circuit boards 20 can be sold together with the display panel 30.

For example, for the production equipment at different production sites, due to the differences in the processes, assembling and the like, the characteristics of the display panels produced by these different production equipment are different. The configuration code stored in the storage circuit 220 in the first circuit board 20 can be set in advance based on the corresponding display panel 30. Because the control circuit board 10 is not required to store the configuration code, the control circuit board 10 possesses versatility, so that a same control circuit board 10 can be used for the display panels 30 produced by different production equipment. In other embodiments, the control circuit board 10 and the display panel 30 may also be sold separately, thereby improving the production efficiency, and reducing the production costs.

The control circuit board 10 and the first circuit board 20 as an example of the additional circuit board included in the display device 1 provided by the embodiments of the present disclosure are respectively described in the following.

Figure 4:
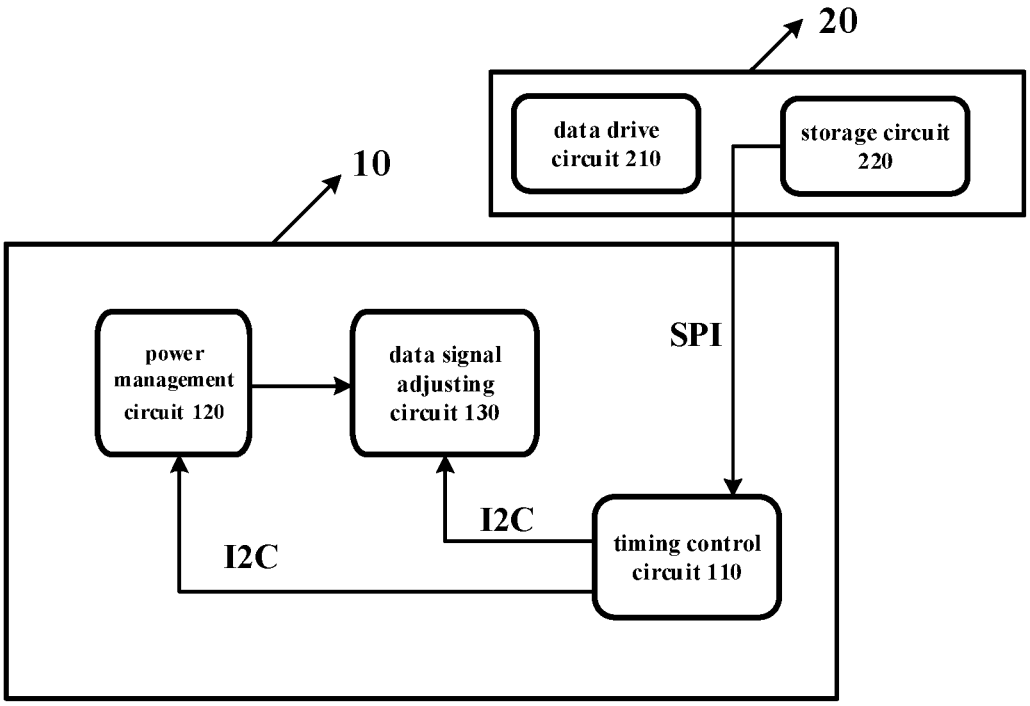
FIG. 4 is a schematic diagram of a control circuit board and an additional circuit board provided by some embodiments of the present disclosure.

Some embodiments of the present disclosure provide a control circuit board 10, as shown in FIG. 4, the control circuit board 10 includes a timing control circuit 110. The timing control circuit 110 is configured to read configuration codes from the storage circuit 220 on the first circuit board 20 outside the control circuit board 10, the configuration codes include a first code for configuring the timing control circuit 110, and the timing control circuit 110 is further configured to generate, based on the first code, a control signal for controlling the display panel 30.

For example, the timing control circuit 110 can transfer a clock signal and the control signal received from the outside to a clock signal and a control signal, which are suitable for the data driving circuit and the gate driving circuit, thereby realizing the display drive of the display panel 30.

For example, the signals received by the timing control circuit 110 from the outside include a clock signal, a horizontal synchronization signal (Hsync), a vertical synchronization signal (Vsync), an enable signal (DE) and so on. For example, the control signals output by the timing control circuit 110 include a start horizontal signal (STH), a clock pulse horizontal signal (CPH), a data output signal (TP), a data polarity reversion signal (POL) and the like for the data driving circuit, and a start vertical signal (STV) and a clock pulse vertical signal (CPV) and the like for the gate driving circuit.

It should be noted that the embodiments of the present disclosure do not limit the digital signal format and the type of the corresponding port adopted by the timing control circuit 110, for example, the formats of the digital signals input into the timing control circuit 110 include a low voltage differential signal (LVDS), an embedded display port (eDP) signal, a transistor to transistor logic (TTL) signal and so on. For example, the formats of the digital signals output by the timing control circuit 110 include TTL, mini-LVDS and so on.

Figure 5:
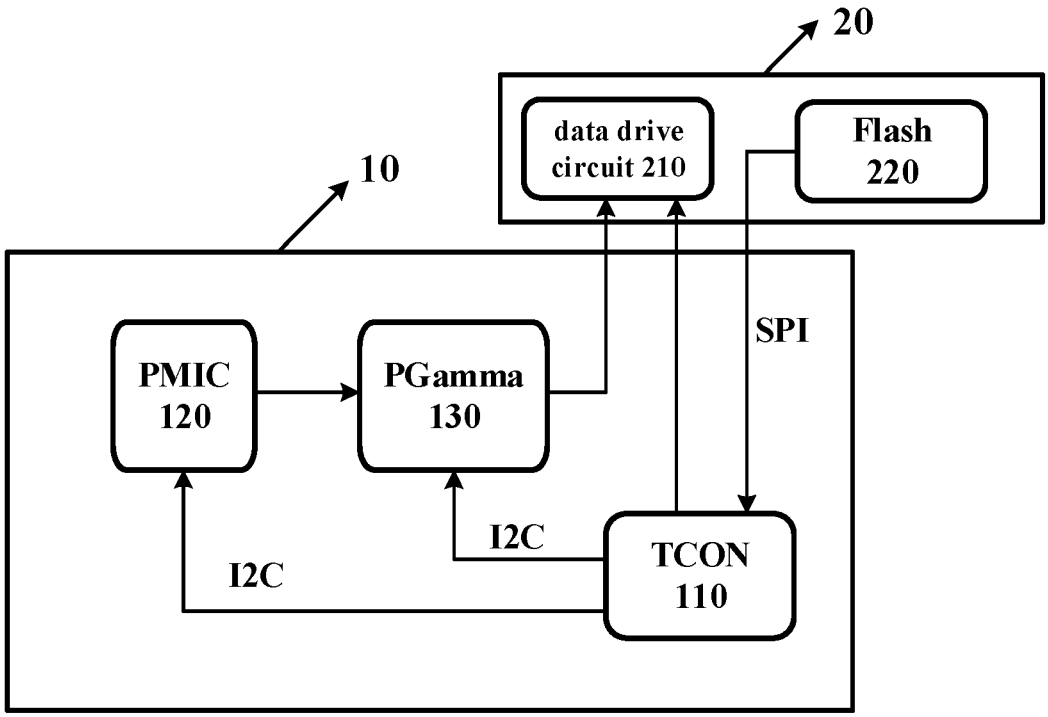
FIG. 5 is a particular circuit diagram of a control circuit board and an additional circuit board provided by some embodiments of the present disclosure.

For example, in some embodiments of the present disclosure, as shown in FIG. 5, the timing control circuit 110 may adopt a timing controller (TCON).

For example, in the control circuit board 10 provided by some embodiments of the present disclosure, the timing control circuit 110 is further configured to distribute the remaining configuration codes other than the first code in the configuration codes to circuits other than the timing control circuit 110. For example, after the timing control circuit 110 obtains the configuration code, the configuration codes may be classified based on the addresses of the configuration codes, and the timing control circuit 110 keeps the first code for configuring the timing control circuit 110 and distributes the remaining configuration codes other than the first code in the configuration codes to other circuits.

For example, as shown in FIG. 4, the control circuit board 10 provided by some embodiment of the present disclosure further includes a power management circuit 120. The configuration codes further include a second code for configuring the power management circuit 120, and the power management circuit 120 is configured to obtain the second code from the timing control circuit 110 and generate, based on the second code, a voltage signal for driving the display panel 30. For example, after receiving the configuration codes, the timing control circuit 110 transmits the second code for configuring the power management circuit 120 in the configuration codes to the power management circuit 120. For example, the timing control circuit 110 may include a binary synchronization serial bus (I2C) port, the power management circuit 120 also includes a binary synchronization serial bus port, the timing control circuit 110 and the power management circuit 120 are in signal connection with each other through an I2C signal line, and thus the timing control circuit 110 can transmit the second code to the power management circuit 120 through the binary synchronization serial bus ports.

The power management circuit 120 generates various voltage signals for driving the display panel to display images, for example, the power management circuit 120 includes a plurality of direct current-direct current (DC/DC) conversion circuits for realizing different circuit functions, including for example a buck DC/DC conversion circuit having a voltage reducing function, a boost DC/DC conversion circuit having a voltage boosting function and a buck-boost conversion circuit having both the voltage boosting function and the voltage reducing function.

For example, the input voltage of the power management circuit 120 may be typically, based on the products, 3.3V (notebook computer), 5V (monitor) and 12V (television). For example, the voltages output by the power management circuit 120 include a digital working voltage ($DV_{DD}$) provided to individual chips, an analog reference voltage ($AV_{DD}$) provided to the data signal adjusting circuit 130, a gate turn-on voltage ($V_{gh}$) and a gate turn-off voltage ($V_{gl}$) provided to the gate driving circuit and a common electrode voltage provided to a common electrode in the display panel.

For example, in some embodiments of the present disclosure, as shown in FIG. 5, the power management circuit 120 may adopt a power management integrated circuit (PMIC).

For example, in the control circuit board 10 provided by some embodiments of the present disclosure, the timing control circuit 110 is further configured to provide a data signal to the data driving circuit 210 on the first circuit board 20. For example, as shown in FIG. 5, the timing control circuit 110 may be in signal connection with the data driving circuit 210 so that the timing control circuit 110 can provide the data signal to the data driving circuit 210. For example, the data signal is a digital signal (with respect to an analog signal). For example, the timing control circuit 110 can obtain the data signal from a data source, for example, obtain the data signal from an external data source or an internal data source. The external data source includes a modem, a data port (for example, a USB port, an HDMI port, etc.); the internal data source includes a data storage circuit (storage), that is, the data signal may be stored in the storage circuit 220 in advance and called from the storage circuit 220 when required.

For example, as shown in FIG. 4, the control circuit board 10 provided by some embodiments of the present disclosure further includes a data signal adjusting circuit 130, and the configuration codes further include a third code for configuring the data signal adjusting circuit 130. The data signal adjusting circuit 130 is configured to obtain the third code from the timing control circuit 110 and generate a gamma reference voltage $V_{Gamma}$ configured to be applied to the data driving circuit 210 on the first circuit board 20. For example, after receiving the configuration codes, the timing control circuit 110 transmits the third code for configuring the data signal adjusting circuit 130 in the configuration codes to the data signal adjusting circuit 130. For example, in a case where the timing control circuit 110 and the data signal adjusting circuit 130 both include the binary synchronization serial bus (I2C) ports, the timing control circuit 110 can transmit the third code to the data signal adjusting circuit 130 through the binary synchronization serial bus ports.

The data signal adjusting circuit 130 receives the analog reference voltage ($AV_{DD}$) provided by the power management circuit 120 and generates the gamma reference voltage $V_{Gamma}$ based on the analog reference voltage. For example, the data signal adjusting circuit 130 may include a resistor network string including a plurality of resistors, gamma correction is configured to adjust the resistor network string, and the gamma reference voltage $V_{Gamma}$ generated by the data signal adjusting circuit 130 is an analog voltage subject to the gamma correction.

For example, in an example, in a case where the digital signal corresponding to the data signal adopts 8 bit data, the data signal adjusting circuit 130 can generate 14 different reference voltages $V_{Gamma}$ based on the analog reference voltage and provide the 14 gamma reference voltages $V_{Gamma}$ to the data driving circuit 210, then the data driving circuit 210 generates 256 grayscale voltage signals VOUT based on the 14 gamma reference voltages $V_{Gamma}$, and the grayscale voltage signals VOUT can be provided to the display panel 30 to drive the display panel 30 to display images.

For example, in some embodiments of the present disclosure, the data signal adjusting circuit 130 may adopt a gamma buffer (Gamma); for example, as shown in FIG. 5, the data signal adjusting circuit 130 may adopt a programmable gamma buffer (Programmable Gamma, PGamma).

For example, in some embodiments of the present disclosure, the configuration codes obtained by the timing control circuit 110 may further include a De-mura code for eliminating display nonuniformity, and the timing control circuit 110 can configure the parameters of individual circuits in the control circuit board 10 after receiving the De-mura code, thereby realizing the function of eliminating display nonuniformity.

In the control circuit board 10 provided by some embodiments of the present disclosure, because the configuration codes are not required to be stored, the control circuit board 10 possesses versatility so that display devices 1 produced by different production equipment may use a same control circuit board 10, and the control circuit board 10 and the display panel 30 can be sold separately, thereby improving the production efficiency and reducing the production costs.

Some embodiments of the present disclosure further provide an additional circuit board which may be for example the above-mentioned first circuit board 20, and as shown in FIG. 3, the first circuit board 20 is configured to be bonded to the display panel 30. For example, the first circuit board 20 may be sold together with the display panel 30.

For example, as shown in FIG. 4, the first circuit board 20 includes a data driving circuit 210 and a storage circuit 220. The storage circuit 220 is configured to store configuration codes, and the configuration codes may be read by the control circuit board 10 to configure the control circuit board 10; the data driving circuit 210 is configured to provide the grayscale voltage signal VOUT to the display panel 30.

For example, as shown in FIG. 4, the first circuit board 20 provided by some embodiments includes a serial peripheral interface (SPI), the timing control circuit 110 also includes a serial peripheral interface, the timing control circuit 110 and the first circuit board 20 are in signal connection with each other through a serial peripheral interface signal line, and the configuration codes stored in the storage circuit 220 may be read by the timing control circuit 110 through the serial peripheral interface.

For example, as shown in FIG. 5, in some embodiments of the present disclosure, the storage circuit 220 may adopt a storage chip which may be of various types, for example, a flash memory (FLASH), an erasable programmable read-only memory (EPROM), an electrical erasable programmable read-only memory (EEPROM), etc.

It should be noted that the embodiments of the present disclosure do not limit the types of the signal connections between the circuits, as long as the signal connections between these circuit can be realized to transmit configuration codes; similarly, the embodiments of the present disclosure do not limit the particular type of the storage circuit 220, as long as the data can be stored and the data will not be lost in case of a power outage.

For example, in the first circuit board 20 provided by some embodiments of the present disclosure, the configuration codes include the code for configuring the timing control circuit 110, and the timing control circuit 110 is configured to generate, based on the first code, the control signal for controlling the display panel 30. The detailed description of the timing control circuit 110 and the first code may refer to the corresponding description of the above-mentioned embodiments, which will not be repeated herein.

For example, in the first circuit board 20 provided by some embodiments of the present disclosure, the configuration codes further include the second code for configuring the power management circuit 120, and the power management circuit 120 is configured to generate, based on the second code, a voltage signal for driving the display panel 30. The detailed description of the power management circuit 120 and the second code may refer to the corresponding description of the above-mentioned embodiments, which will not be repeated herein.

For example, in the first circuit board 20 provided by some embodiments of the present disclosure, the configuration codes further include a third code for configuring the data signal adjusting circuit 130, and the data signal adjusting circuit 130 is configured to generate, based on the third code, the gamma reference voltage $V_{Gamma}$ configured to be applied to the data driving circuit 210.

Figure 6:
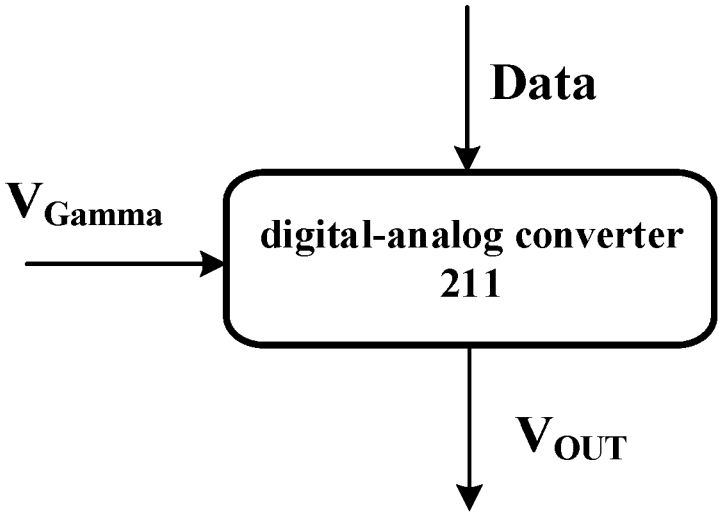
FIG. 6 is a schematic diagram of a data driving circuit provided by some embodiments of the present disclosure.

For example, as shown in FIG. 6, the data driving circuit 210 includes a digital-analog converter (DAC) 211. The digital-analog converter 211 obtains the gamma reference voltage $V_{Gamma}$ from the data signal adjusting circuit 130 and obtains the data signal Data from the timing control circuit 110, the digital-analog converter 211 can generate the grayscale voltage signal $V_{OUT}$ based on the gamma reference voltage $V_{Gamma}$ and the data signal Data, and the grayscale voltage signal $V_{OUT}$ may be provided to the display panel 30 to drive the display panel 30 to display images.

Figure 7:
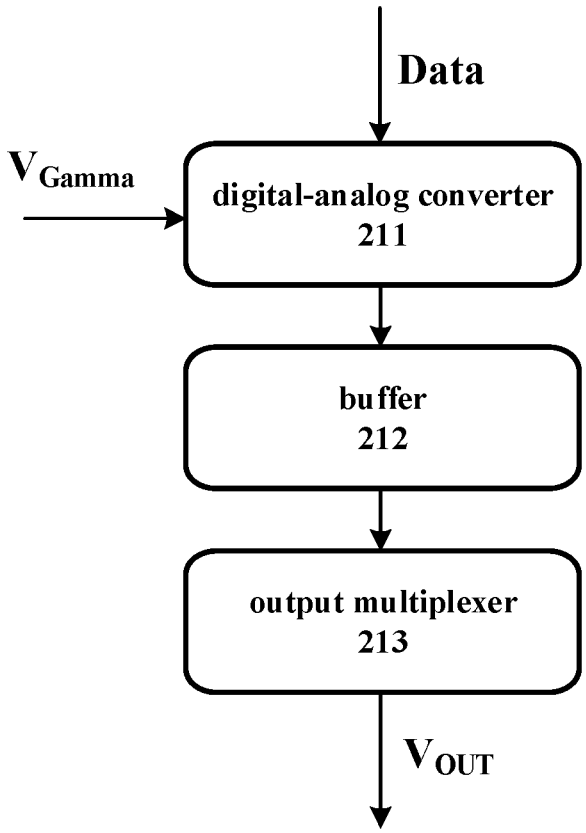
FIG. 7 is a schematic diagram of another data driving circuit provided by some embodiments of the present disclosure.

For example, as shown in FIG. 7, the data driving circuit 210 may further include a buffer 212 and an output multiplexer 213. The buffer 212 is configured to improve the load capacity of the output voltage converted by the digital-analog converter 211, that is, converting the analog voltage having a low load capacity output by the digital-analog converter 211 into an analog voltage having a high load capacity. The output multiplexer 213 may include a plurality of output channels, for example, each output channel corresponds to a column of pixel units in the display panel 30. For example, in a case where the display panel 30 adopts an AC drive manner, that is, the polarity of the grayscale voltage signal $V_{OUT}$ is alternatively positive and negative with respect to the common electrode voltage ($V_{COM}$) between frames, and the output multiplexer 213 can control to output grayscale voltage signals VOUT having different polarities.

In the first circuit board 20 provided by some embodiments, the storage circuit 220 may store the configuration codes in the code format as shown in the below table 1. For example, as shown in table 1, the six-bit data at the left side represents the corresponding address of the configuration code, for example, the address begins from 000000. The 128-bit data (00, 01, . . . , 0F) at the right side represents the configuration code stored by the storage circuit 220. For example, the configuration codes stored by the storage circuit 220 include the first code, the second code, the third code and the De-mura code. In addition, the storage circuit 220 may set some reserved positions in advance to have enough storage space to change the configuration codes when required.

TABLE 1

| | | code | | | | | | | | | | | | | | | |
|---|---|---|---|---|---|---|---|---|---|---|---|---|---|---|---|---|---|
| | | 00 | 01 | 02 | 03 | 04 | 05 | 06 | 07 | 08 | 09 | 0A | 0B | 0C | 0D | 0E | 0F |
| address | 000000 | | | | | | | | first code | | | | | | | | |
| | xxxxxx | | | | | | | | second code | | | | | | | | |
| | xxxxxx | | | | | | | | third code | | | | | | | | |
| | xxxxxx | | | | | | | | reserved position | | | | | | | | |
| | xxxxxx | | | | | | | | De-mura code | | | | | | | | |

It should be noted that the code format as shown in table 1 is merely an example, and the embodiments of the present disclosure include, but are not limited to, this format.

The first circuit board 20 provided by some embodiments of the present disclosure can store the configuration code for configuring the control circuit board 10 so that the codes for configuring individual circuits on the control circuit board 10 are stored in the storage circuit 220, thereby facilitating the management of the configuration codes, improving the production efficiency and reducing the production costs.

Some embodiments of the present disclosure further provide a display device 1, as shown in FIG. 3, the display device includes the control circuit board 10 provided by any embodiment of the present disclosure, the additional circuit board and the display panel 30. For example, the additional circuit board may be the above-mentioned first circuit board 20. For example, the first circuit board 20 is bonded to the display panel 30, and the first circuit board 20 is in signal connection with the control circuit board 10.

For example, the display device 1 provided by some embodiments of the present disclosure may further include a flexible circuit board FPC, and the control circuit board 10 is in signal connection with the first circuit board 20 through the flexible circuit board FPC.

Figure 8:
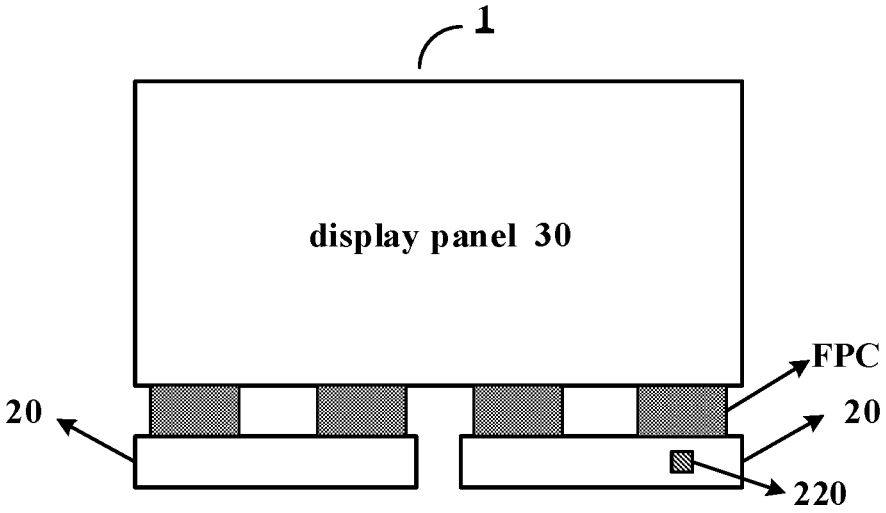
FIG. 8 is a schematic diagram of another display device provided by some embodiments of the present disclosure.

Some embodiments of the present disclosure further provide a display device 1, as shown in FIG. 8, the display device includes the additional circuit board provided by any embodiment of the present disclosure and the display panel 80, and the additional circuit board may be for example the above-mentioned first circuit board 20. The first circuit board 20 is bonded to the display panel 30. The display panel 30 may be for example a liquid crystal panel, an OLED panel, an electronic paper panel, etc. In some embodiments of the present disclosure, the display device 1 further includes a second circuit board which may be for example the Y-direction circuit board (YPCB) as shown in FIG. 1. In some embodiments of the present disclosure, an array substrate of the display panel may be a GOA array substrate, i.e., the gate driving circuit is integrated on the array substrate.

It should be noted that the display device 1 provided by the embodiments of the present disclosure may be any product or component having a display function such as a liquid crystal panel, a liquid crystal television, a display, an OLED panel, an OLED television, an electronic paper display device, a mobile phone, a tablet computer, a notebook computer, a digital photo frame, a navigator.

It should be noted that the technical effects in connection with the control circuit board 10 and the first circuit board 20 may refer to the corresponding description of the above-mentioned embodiments, which will not be repeated herein.

Figure 9:
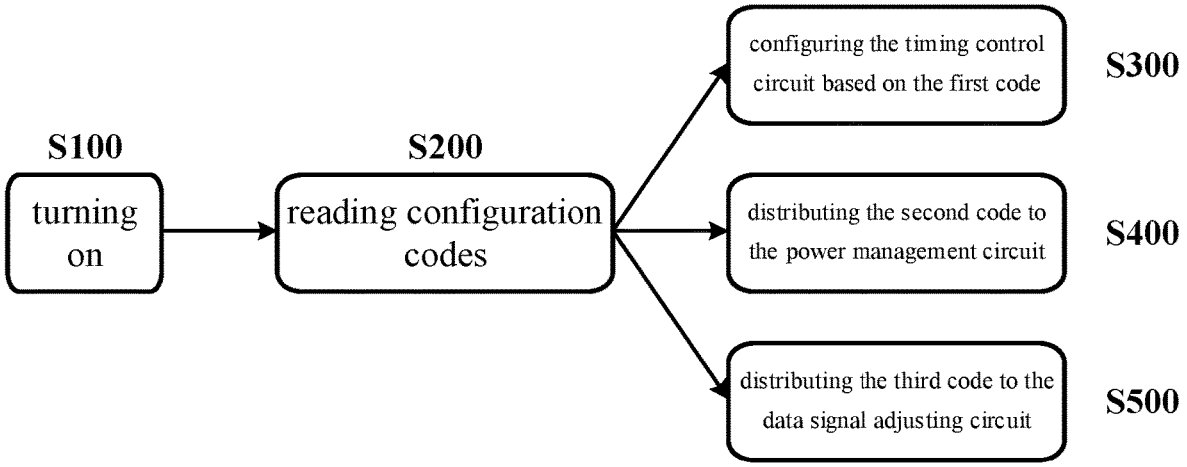
FIG. 9 is a schematic diagram of a control method provided by some embodiments of the present disclosure.

Some embodiments of the present disclosure further provide a control method which is applicable to any display device 1 provided by the embodiments of the present disclosure and includes the following operations as shown in FIG. 9.

Step S100: turning on. For example, the display device 1 is energized to be turned on.

Step S200: reading configuration codes. For example, the timing control circuit 110 of the control circuit board 10 reads the configuration codes from the storage circuit 220 of the first circuit board 20, and the configuration codes are configured to configure the control circuit board 10.

Step S300: configuring the timing control circuit 110 based on the first code. For example, after obtaining the configuration codes, the timing control circuit 110 can classify the configuration codes based on the addresses of the configuration codes, and keep the first code for the timing control circuit 110 and distributes the remaining configuration codes other than the first code in the configuration codes to other circuits.

Step S400: distributing the second code to the power management circuit 120. For example, after obtaining the configuration codes, the timing control circuit 110 transmits the second code of the configuration codes to the power management circuit 120.

Step S500: distributing the third code to the data signal adjusting circuit 130. For example, after obtaining the configuration codes, the timing control circuit 110 transmits the third code of the configuration codes to the data signal adjusting circuit 130.

The foregoing is merely exemplary embodiments of the present disclosure, and not intended to define the scope of the present disclosure, and the scope of the present disclosure is determined by the appended claims.

What is claimed is:

1. A control circuit board, comprising:

a timing control circuit, wherein the timing control circuit is configured to read a configuration code from a storage circuit on an additional circuit board outside the control circuit board, the configuration code comprises a first code for configuring the timing control circuit, and the timing control circuit is further configured to generate, based on the first code, a control signal for controlling a display panel; and wherein the timing control circuit is further configured to distribute a remaining configuration code other than the first code in the configuration code to an outside of the timing control circuit.

2. The control circuit board according to claim 1, further comprising a power management circuit, wherein the configuration code further comprises a second code for configuring the power management circuit, and the power management circuit is configured to obtain the second code from the timing control circuit and generate, based on the second code, a voltage signal for driving the display panel.

3. The control circuit board according to claim 2, wherein the power management circuit comprises a power management integrated circuit.

4. The control circuit board according to claim 1, wherein the timing control circuit is further configured to provide a data signal to a data driving circuit on the additional circuit board.

5. The control circuit board according to claim 4, further comprising a data signal adjusting circuit, wherein the configuration code further comprises a third code for configuring the data signal adjusting circuit, the data signal adjusting circuit is configured to obtain the third code from the timing control circuit and generate, based on the third code, a gamma reference voltage configured to be applied to the data driving circuit on the additional circuit board.

6. The control circuit board according to claim 5, wherein the data signal adjusting circuit comprises a gamma buffer.

7. The control circuit board according to claim 1, wherein the timing control circuit comprises a binary synchronization serial bus interface, and the timing control circuit distributes the remaining configuration code other than the first code in the configuration code to the outside of the timing control circuit through the binary synchronization serial bus interface.

8. A display device, comprising:

the control circuit board according to claim 1, and an additional circuit board and a display panel, wherein the additional circuit board is bonded to the display panel, the additional circuit board is in signal connection with the control circuit board, and the additional circuit board comprises a data driving circuit and a storage circuit, the storage circuit is configured to store a configuration code, the configuration code is capable of being read by the control circuit board to configure the control circuit board, and the data driving circuit is configured to provide a grayscale voltage signal to the display panel.

9. The display device according to claim 8, wherein the control circuit board further comprises a power management circuit, the configuration code further comprises a second code for configuring the power management circuit, and the power management circuit is configured to obtain the second code from the timing control circuit and generate, based on the second code, a voltage signal for driving the display panel.

10. The display device according to claim 8, wherein the timing control circuit is further configured to provide a data signal to a data driving circuit on the additional circuit board;

the control circuit board further comprises a data signal adjusting circuit, the configuration code further comprises a third code for configuring the data signal adjusting circuit, and the data signal adjusting circuit is configured to obtain the third code from the timing control circuit and generate, based on the third code, a gamma reference voltage configured to be applied to the data driving circuit on the additional circuit board.

11. The display device according to claim 8, further comprising a flexible circuit board, wherein the control circuit board is in signal connection with the additional circuit board through the flexible circuit board.

12. An additional circuit board, configured to be bonded to a display panel and comprising:

a data driving circuit and a storage circuit, wherein the storage circuit is configured to store a configuration code, and the configuration code is capable of being read by a control circuit board to configure the control circuit board, and the data driving circuit is configured to provide a grayscale voltage signal to the display panel;

wherein the configuration code comprises a first code for configuring a timing control circuit, and the timing control circuit is configured to generate, based on the first code, a control signal for controlling the display panel; and wherein the timing control circuit is further configured to distribute a remaining configuration code other than the first code in the configuration code to an outside of the timing control circuit.

13. The additional circuit board according to claim 12, wherein the configuration code comprises a second code for configuring a power management circuit, and the power management circuit is configured to generate, based on the second code, a voltage signal for driving the display panel.

14. The additional circuit board according to claim 12, wherein the configuration code comprises a third code for configuring a data signal adjusting circuit, and the data signal adjusting circuit is configured to generate, based on the third code, a gamma reference voltage configured to be applied to the data driving circuit.

15. The additional circuit board according to claim 12, further comprising a serial peripheral interface, wherein the configuration code stored in the storage circuit is read through the serial peripheral interface.

16. A display device, comprising the additional circuit board according to claim 12 and a display panel, the additional circuit board being bonded to the display panel.

17. A display device, comprising: a control circuit board, an additional circuit board and a display panel, wherein the additional circuit board is configured to be bonded to the display panel and comprises a data driving circuit and a storage circuit, the storage circuit is configured to store a configuration code, the configuration code is capable of being read by the control circuit board to configure the control circuit board, and the data driving circuit is configured to provide a grayscale voltage signal to the display panel, the control circuit board comprises a timing control circuit, a power management circuit and a data signal adjusting circuit, the timing control circuit is configured to read the configuration code from the storage circuit on the additional circuit board, the configuration code comprises a first code for configuring the timing control circuit, a second code for configuring the power management circuit, and a third code for configuring the data signal adjusting circuit, the timing control circuit is further configured to generate, based on the first code, a control signal for controlling the display panel and distribute a remaining configuration code other than the first code in the configuration code to an outside of the timing control circuit, the power management circuit is configured to obtain the second code from the timing control circuit and generate, based on the second code, a voltage signal for driving the display panel, and the data signal adjusting circuit is configured to obtain the third code from the timing control circuit and generate, based on the third code, a gamma reference voltage configured to be applied to the data driving circuit on the additional circuit board.

* * * * *